US007758226B2

(12) United States Patent
Wang et al.

(10) Patent No.: US 7,758,226 B2
(45) Date of Patent: Jul. 20, 2010

(54) BILLBOARD AND FABRICATION THEREOF

(75) Inventors: Meng-Hua Wang, Miao-Li Hsien (TW); Feng-Cheng Chung, Miao-Li Hsien (TW); Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 196 days.

(21) Appl. No.: 12/177,413

(22) Filed: Jul. 22, 2008

(65) Prior Publication Data

US 2009/0168451 A1 Jul. 2, 2009

(51) Int. Cl.
*G09F 13/18* (2006.01)

(52) U.S. Cl. ..... 362/602; 362/812

(58) Field of Classification Search ..... 362/97.4, 362/559, 576, 602, 812
See application file for complete search history.

(56) References Cited

U.S. PATENT DOCUMENTS

2003/0223217 A1* 12/2003 Wright et al. ..... 362/31
2010/0014311 A1* 1/2010 Danieli ..... 362/606

FOREIGN PATENT DOCUMENTS

CN 1584957 A 2/2005
CN 1896775 A 1/2007

* cited by examiner

*Primary Examiner*—David V Bruce
(74) *Attorney, Agent, or Firm*—Andrew C. Cheng

(57) ABSTRACT

An exemplary billboard includes a backlight module, a light transmissive canvas, a pattern layer and a light converging layer. The light transmissive canvas is adjacent to the backlight module. The light transmissive canvas includes a first surface facing the backlight module and a second surface opposite to the first surface. The pattern layer is formed on the second surface. The light converging layer covers the pattern layer and comprises a plurality of microstructures formed thereon distal from the light transmissive canvas.

10 Claims, 4 Drawing Sheets

BILLBOARD AND FABRICATION THEREOF

BACKGROUND

1. Technical Field

The present invention generally relates to billboards and, particularly, to a billboard capable of emitting light, and a fabrication method thereof.

2. Discussion of Related Art

Conventional billboards generally include a light transmissive canvas on which patterns are printed. Due to the fact that the light transmissive canvas cannot emit light on its own, visibility of the patterns printed thereon can becomes limited in a dark environment.

Accordingly the light transmissive canvas is usually illuminated by a backlight module, for example a side backlight module or direct backlight module. Light from the backlight module, however, is dispersive and the canvas exposed to the environments can easily suffer damage.

Therefore, what is needed is a billboard capable of overcoming the described shortcomings.

SUMMARY

A billboard, in accordance with a present embodiment, is provided. The billboard includes a backlight module, a light transmissive canvas, a pattern layer, and a light converging layer. The backlight module is configured for illuminating the light transmissive canvas. The light transmissive canvas is adjacent to the backlight module. The light transmissive canvas comprises a first surface facing the backlight module and a second surface opposite to the first surface. The pattern layer is formed on the second surface to carry graphic content. The light converging layer covers the pattern layer and comprises a plurality of microstructures formed thereon distal from the light transmissive canvas. The light converging layer is configured for converging light emitted from the backlight module and protecting the pattern layer.

Detailed features of the billboard will become more apparent from the following detailed description and claims, and the accompanying drawings.

BRIEF DESCRIPTION OF THE DRAWINGS

Many aspects of the present billboard can be better understood with reference to the following drawings. The components in the drawings are not necessarily drawn to scale, the emphasis instead being placed upon clearly illustrating the principles of the present billboard. Moreover, in the drawings, like reference numerals designate corresponding parts throughout the several views, wherein.

DETAILED DESCRIPTION OF THE PREFERRED EMBODIMENTS

Figure 1:
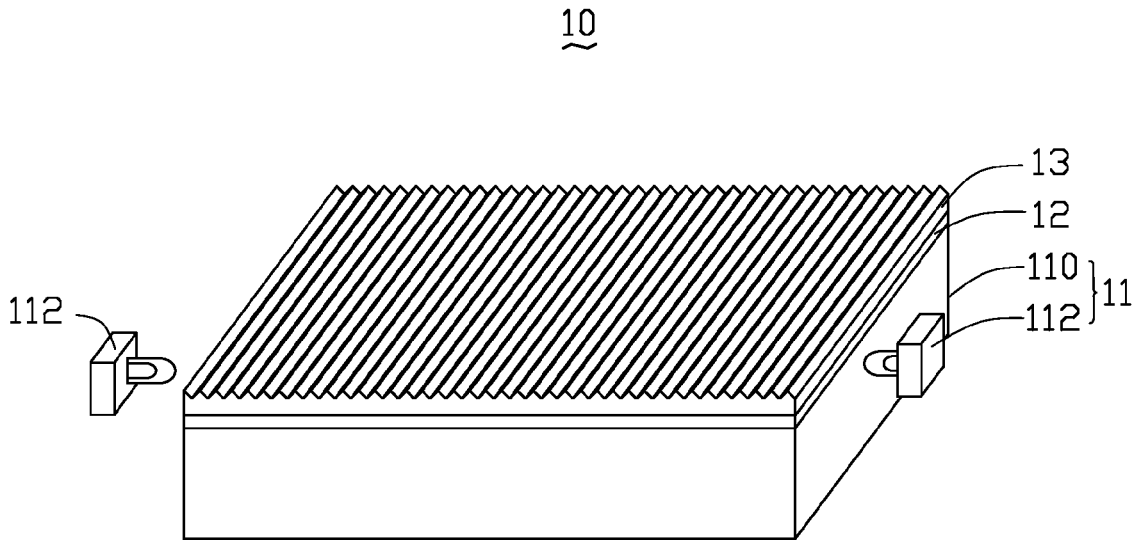
FIG. 1 is a schematic isometric view of a billboard, according to a first exemplary embodiment.

Reference will now be made to the drawing to describe the embodiments of the present billboard, in detail.

Referring to FIG. 1, a billboard 10, according to an exemplary embodiment, is provided. The billboard 10 includes a backlight module 11, a light transmissive canvas 12, and a light converging layer 13.

The backlight module 11 is configured for illuminating the light transmissive canvas 12. The backlight module 11 can be a side backlight module or a direct backlight module. In an example, the backlight module 11 is a side backlight module including a light guiding plate 110 and two light sources 112.

Figure 2:
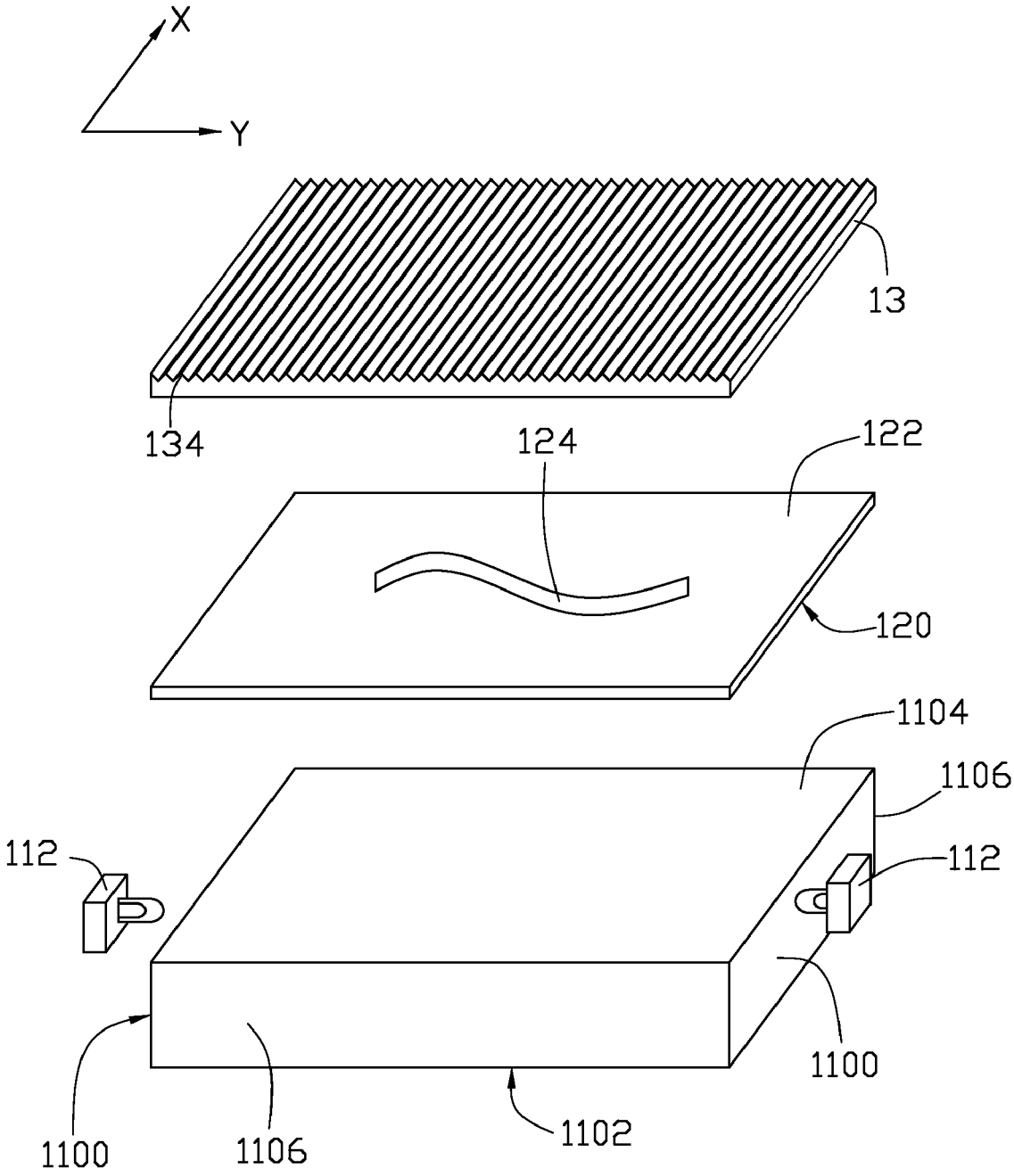
FIG. 2 is an exploded view of the billboard illustrated in FIG. 1.

Referring to FIG. 2, the light guiding plate 110 includes two light incident surfaces 1100 opposite to each other, a bottom surface 1102 adjacent to the incident surfaces 1100, a light-emitting surface 1104 opposite to the bottom surface 1102, and two side surfaces 1106 between the bottom surface 1102 and the light-emitting surface 1104 and adjacent to the two light incident surfaces 1100. For improving uniformity of light emitted from light guide plate 110, the bottom surface 1102 includes a plurality of light scattering dots (not illustrated) thereon. The light scattering dots are arranged on the bottom surface 1102 in various distributions. For improving efficiency of light use, at least one of the bottom surface 1102 and the two side surfaces 1106 has a light reflective film or a light reflective plate (not illustrated) thereon. Thereby, the light incident onto the bottom surface 1102 or/and the two side surfaces 1106 is reflected and then emits from the light-emitting surface 1104. At least one of the light incident surface 1100 and the light-emitting surface 1104 has an anti-reflective film thereon to reduce light consumption. The light guiding plate 110 can be polymethylmethacrylate (PMMA), polycarbonate (PC), or cycio olefins polymer (COP).

The light sources 112 respectively face the light incident surfaces 1100. The light sources 112 may be cold cathode fluorescent lamps, light emitting diodes, or organic light emitting diodes, and in this embodiment, are light emitting diodes.

The light transmissive canvas 12 is adjacent to the backlight module 11. In this exemplary embodiment, the light transmissive canvas 12 is on the light-emitting surface 1104 of the light guide plate 110. The light transmissive canvas 12 can be plastic, such as polyvinylchloride (PVC). The light transmissive canvas 12 includes a first surface 120 attached to the light-emitting surface 1104, and a second surface 122 opposite to the first surface 120. The second surface 122 has a pattern layer 124 thereon. Light from the light-emitting surface 1104 enters the light transmissive canvas 12 from the first surface 120 thereof, and passes through the light transmissive canvas 12, and thereafter from the second surface 122 thereof.

The light converging layer 13 is configured for converging light from the second surface 122 and protecting the pattern layer 124 of the light transmissive canvas 12. The light converging layer 13 is formed on the second surface 122 and covers the pattern layer 124. The light converging layer 13 can be resin or silicon gel, which may be solidified by ultraviolet. The refractive index of the converging layer 13 is 1.4 to 1.6, and the rigidity of the converging layer is 1 to 150 after being solidified. The light converging layer 13 includes a plurality of microstructures formed on a surface thereof distal from the light transmissive canvas 12. In this exemplary embodiment, the microstructures are serrations 134 extending along a the X axis as illustrated in FIG. 2. The serrations 134 are aligned along the Y axis as illustrated in FIG. 2, and parallel. The serrations 134 can converge light emitted from the second surface 122, thereby facilitating the converging function of the light converging layer 13. Because the converging layer 13 covers the pattern layer 124 formed on the second surface 122, the converging layer 13 can also protect the pattern layer 124 from external damage.

A process for manufacturing the billboard 10 is also provided, the process including, In Step I: providing a light transmissive canvas 12 with a first surface and a second surface opposite thereto, with a pattern layer (not illustrated) thereon.

In Step II a coating 130 is formed on the second surface of the light transmissive canvas 12 to cover the pattern layer. The coating 130 is resin or silicon gel, which may be solidified by ultraviolet.

In Step III, a plurality of microstructures are formed on a surface of the coating 130 distal from the light transmissive canvas 12 and solidified via ultraviolet.

In Step IV, light transmissive canvas 12 is situated adjacent to a backlight module 11 with the first surface facing a light-emitting surface 1104 of the backlight module 11.

Figure 3:
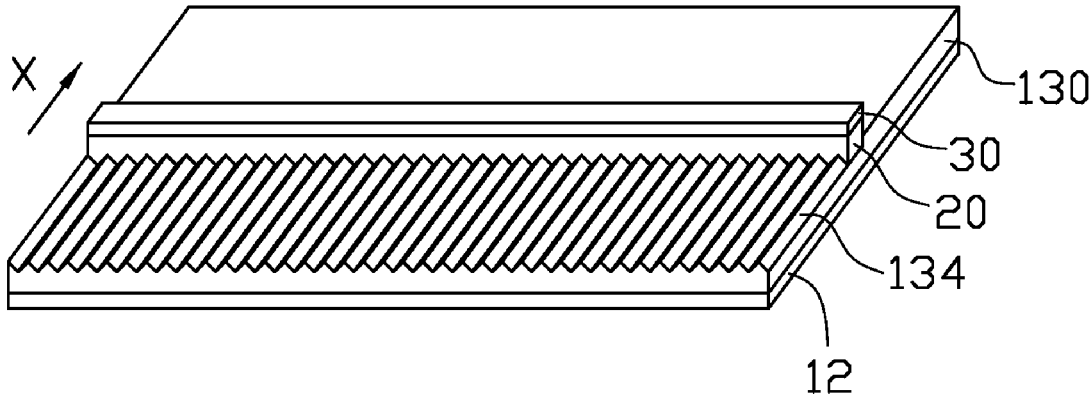
FIG. 3 is a schematic view of forming microstructures on surface of the light converging layer.

In Step III, the microstructures, serrations 134 as shown in FIG. 3, can be formed by providing a device 20 comprising microstructures of serrations capable of permitting ultraviolet there through, scraping the microstructures of the device 20 over the coating 130 along the X axis parallel to the second surface, thereby forming serrations 134 on the surface of the coating 130, ultraviolet irradiating the device 20 with the ultraviolet ray passing through device 20 and illuminating coating 130, such that serrations 134 are formed on the coating 130 and solidified by the ultraviolet ray. As such, the light converging layer 13 is manufactured.

Figure 4:
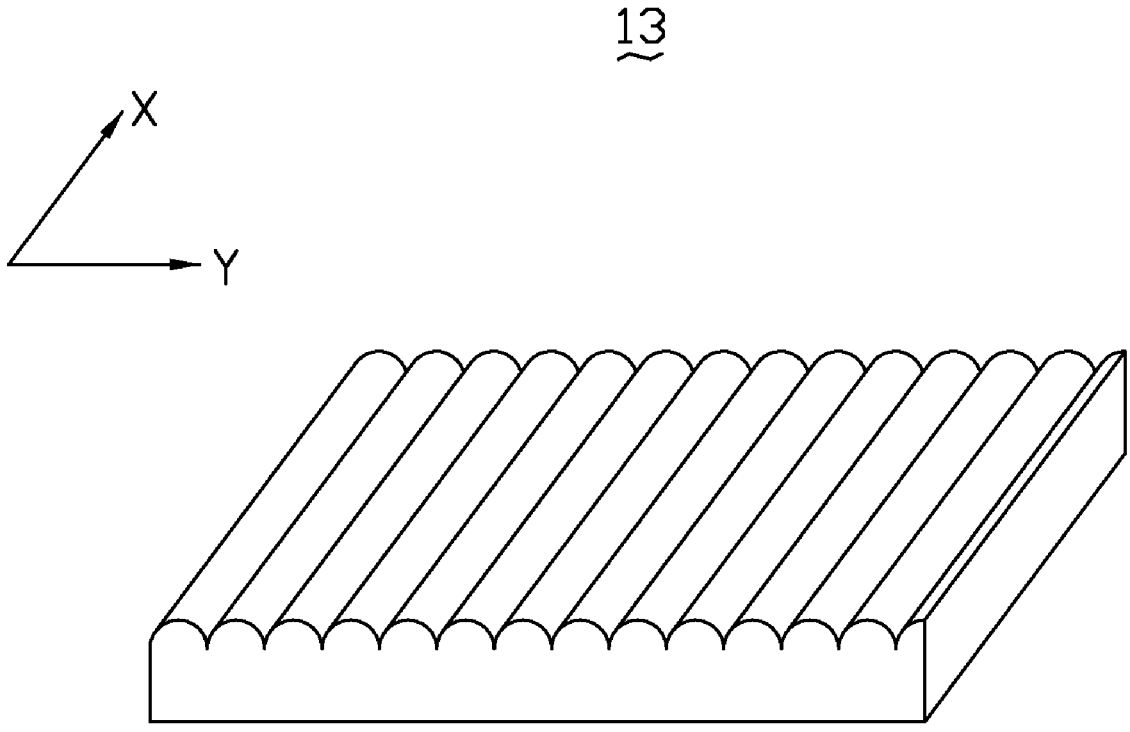
FIG. 4 is a schematic isometric view of a light converging layer having microstructures of column lens.

It is to be understood that the serrations 134 of the light converging layer 13 can also be replaced by other microstructures. Referring to FIG. 4, the microstructures can be column lenses parallel to the X axis, or, alternatively, along of the Y axis and parallel.

In sum, with the backlight module 11 illuminating the light transmissive canvas 12 and the light converging layer 13 for converging emitted light and protecting the pattern layer 124, the billboard 10 provides more efficient results in darker environments with the pattern layer 124 protected from external damage.

Finally, it is to be understood that the above-described embodiments are intended to illustrate rather than limit the invention. Variations may be made to the embodiments without departing from the spirit of the invention as claimed. The above-described embodiment illustrates the scope of the invention but do not restrict the scope of the invention.

What is claimed is:

1. A billboard, comprising:

a backlight module;

a light transmissive canvas adjacent to the backlight module, comprising a first surface facing the backlight module and a second surface opposite to the first surface;

a pattern layer formed on the second surface; and a light converging layer covering the pattern layer, the light converging layer comprising a plurality of microstructures formed on a surface thereof distal from the light transmissive canvas;

wherein the backlight module is configured for illuminating the light transmissive canvas, the pattern layer is configured for bearing graphical content, and the light converging layer is configured for converging light emitted from the backlight module and protecting the pattern layer.

2. The billboard according to claim 1, wherein the backlight module comprises a light source and a light guiding plate, the light guiding plate comprises a light incident surface and a light-emitting surface, the light source is arranged facing toward the light incident surface, and the first surface of the light transmissive canvas faces the light-emitting surface.

3. The billboard according to claim 1, wherein the pattern layer is a dye layer on the second surface of the light transmissive canvas.

4. The billboard according to claim 1, wherein the light converging layer is solidified resin or solidified silica gel.

5. The billboard according to claim 4, wherein the light converging layer has a refractive index of 1.4 to 1.6.

6. The billboard according to claim 1, wherein the microstructures are parallel serrations protruding along a first axis and running along a second axis, perpendicular to the first axis.

7. The billboard according to claim 1, wherein the microstructures are column lenses protruding along a first axis and running along a second axis, perpendicular to the first axis.

8. A process for manufacturing a billboard, comprising:

providing a light transmissive canvas having a first surface and a second surface opposite to the first surface, the second surface having a pattern layer formed thereon;

forming a coating on the second surface to cover the pattern layer;

forming a plurality of microstructures on a surface of the coating distal from the light transmissive canvas and solidifying the coating via ultraviolet;

arranging the light transmissive canvas adjacent to a backlight module with the first surface facing a light-emitting surface of the backlight module.

9. The process for manufacturing a billboard according to claim 8, wherein the coating is resin or silicon gel that can be solidified by ultraviolet.

10. A process for manufacturing a billboard according to claim 8, wherein the microstructures are formed by:

providing a device that comprises microstructures of serrations or column grooves and permits ultraviolet to pass;

scraping the microstructures of the device over the coating along a first axis parallel to the second surface, and irradiating the device with ultraviolet which passes through the device, incident on the coating.

* * * * *